United States Patent [19]

Gir et al.

[11] Patent Number: 4,664,788

[45] Date of Patent: May 12, 1987

[54] MULTI-STAGE COAL LIQUEFACTION AND FRACTIONATION METHOD

[75] Inventors: Srikant Gir, Memphis, Tenn.; Donald E. Rhodes, Oklahoma City, Okla.

[73] Assignee: Kerr-McGee Corporation, Oklahoma City, Okla.

[21] Appl. No.: 777,766

[22] Filed: Sep. 19, 1985

[51] Int. Cl.[4] ..... C10G 21/00; C10G 21/14; C10G 29/20

[52] U.S. Cl. ..... 208/415; 208/424; 208/429; 208/434; 208/952

[58] Field of Search ..... 208/8 LE, 177, 251 R, 208/415, 424, 425, 434, 952

[56] References Cited

U.S. PATENT DOCUMENTS

| | | | |
|---|---|---|---|
| 2,940,920 | 6/1960 | Garwin | 208/309 |
| 3,607,716 | 9/1971 | Roach | 208/8 |
| 3,607,717 | 9/1971 | Roach | 208/8 |
| 3,607,718 | 9/1971 | Leaders et al. | 208/10 |
| 4,040,958 | 8/1977 | Rammler | 208/177 |
| 4,119,525 | 10/1978 | Leonard et al. | 208/8 LE |
| 4,162,965 | 7/1979 | Clapper | 208/177 |
| 4,164,466 | 8/1979 | Baldwin et al. | 208/177 |
| 4,177,135 | 12/1979 | Rhodes | 208/177 |
| 4,189,372 | 2/1980 | Baldwin et al. | 208/8 LE |
| 4,225,420 | 9/1980 | Rhodes | 208/177 |
| 4,334,977 | 6/1982 | Derbyshire et al. | 208/8 LE |

*Primary Examiner*—Glenn Caldarola

*Attorney, Agent, or Firm*—William G. Addison

[57] ABSTRACT

A multi-stage coal liquefaction method in which coal is slurried with a primary light solvent, such as toluene, hexane and/or cyclohexane, and a process-derived primary heavy solvent. The coal-primary solvent slurry is treated under coal-liquefying conditions to form a first feed solution containing coal liquefaction products. The first feed solution is treated by a multi-stage supercritical solvent extraction procedure. The final heavy phase produced by this procedure is mixed with a secondary solvent, such as pentane, to produce a second feed mixture, which is treated in a second multi-stage supercritical solvent extraction procedure. Heavy phases recovered from the separate stages of both solvent extraction procedures are blended to provide a recycled primary heavy solvent.

31 Claims, 2 Drawing Figures

MULTI-STAGE COAL LIQUEFACTION AND FRACTIONATION METHOD

FIELD OF THE INVENTION

The present invention relates generally to extraction of coal liquefaction products from solid coal.

SUMMARY OF THE INVENTION

The present invention comprises a method of fractionating coal liquefaction products by preparing a primary feed solution comprising coal liquefaction products, a primary heavy solvent, and a primary light solvent. At least a portion of the primary feed solution is introduced into a first primary separation zone to form a first light primary phase and a first heavy primary phase, separated by a liquid-liquid interface. At least a portion of the first light primary phase in turn is processed in at least one additional primary separation zone, successive to the first primary separation zone, to separate in a final successive primary separation zone a final light phase and a final heavy phase.

At least a portion of the final heavy primary phase is mixed with a secondary solvent to form a secondary feed solution, which is introduced into a first secondary separation zone to form a first light secondary phase and a first heavy secondary phase, separated by a liquid-liquid interface. At least a portion of the first light secondary phase in turn is processed in at least one additional secondary separation zone, successive to the first secondary separation zone, to separate in a final successive secondary separation zone a final light secondary phase and a final heavy secondary phase. At least a portion of at least one of the heavy secondary phases and the heavy primary phases, other than the first heavy primary phase, is recycled to provide at least a portion of the primary heavy solvent.

DETAILED DESCRIPTION OF THE PREFERRED EMBODIMENTS

Figure 1:
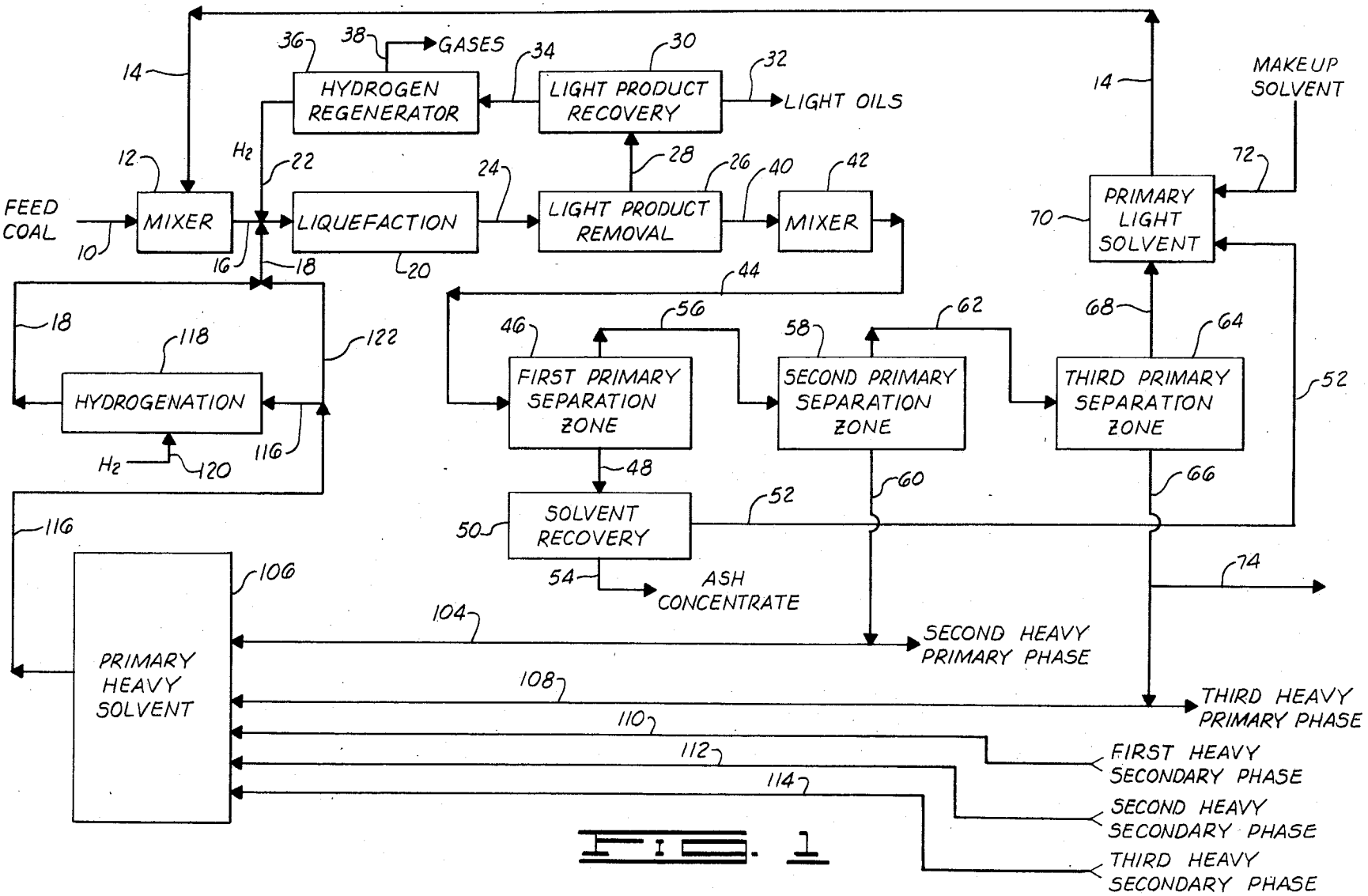
FIG. 1 is a schematic, diagrammatic depiction of the flow of materials in the method of the present invention.

With reference to FIG. 1, the present invention comprises a method for liquefying coal in which coal is transferred via a conduit or conveyor 10 into a first mixing zone 12, which preferably comprises a mixer equipped with a motor-driven agitator. In the mixing zone 12, the coal is mixed with a primary light solvent, which preferably is received in the mixing zone 12 via a conduit 14. The primary light solvent is mixed with the coal to produce a coal-primary light solvent slurry.

The coal used in the method of the present invention preferably is of a rank lower than anthracite, such as subanthracite, bituminous, subbituminous, lignite, brown coal, or peat. The particle size of the coal may vary over wide ranges and in general the particles need be only sufficiently small to be slurried in the solvent and pumped. For instance, the coal may have an average particle size of one-fourth inch in diameter or larger in some instances, and as small as minus 200 mesh (Tyler Screen) or smaller. The most practical particle size is often between minus 30 mesh and minus 100 mesh, as less energy is required for grinding this size of the particles, which are sufficiently small to achieve an optimum rate of solubilization. The particle size of the coal is not of great importance as long as extremely large particles are not present.

The primary light solvent comprises, and preferably consists essentially of one or more substances having a critical temperature below 800° F. selected from the group consisting of aromatic hydrocarbons having a single benzene nucleus and normal boiling points below about 310° F., cycloparaffin hydrocarbons having normal boiling points below about 310° F., open chain mono-olefin hydrocarbons having normal boiling points below about 310° F., open chain saturated hydrocarbons having normal boiling points below about 310° F., mono-, di- and tri-open chain amines containing between about 2 and about 8 carbon atoms, carbocyclic amines having a monocyclic structure containing between about 6 and about 9 carbon atoms, heterocyclic amines containing between about 5 and about 9 carbon atoms, and phenols containing from between about 6 and about 9 carbon atoms, and their homologs. More preferably, the primary light solvent includes at least one light aromatic solvent, having a single benzene nucleus and more preferably between 6 and 9 carbon atoms. In general, this light aromatic solvent may comprise one or more monocyclic hydrocarbons having a normal boiling point below about 310° F. Hydrocarbons which are preferred for use in the primary light solvent include benzene, toluene, o-, m- and p-xylene, ethyl benzene and n-propyl and isopropyl benzene. The primary light solvent most preferably comprises, and consists essentially of, at least one of toluene, cyclohexane and hexane.

The coal-primary light solvent slurry is withdrawn from the first mixing zone 12 via a conduit 16, where a primary heavy solvent is mixed with the coal-primary light solvent slurry. The primary heavy solvent is introduced into the conduit 16 via a conduit 18. In an alternate embodiment, not shown in the Figures, the primary heavy solvent may be introduced into the first mixing zone 12, together with the primary light solvent and the coal.

The primary heavy solvent preferably is a process-derived solvent material rich in hydrogen donor compounds, such as tetrahydroquinoline, which are effective coal solubilization agents. The formulation and preparation of the primary heavy solvent will be described in greater detail hereafter. The primary light solvent and the primary heavy solvent, which will be designated collectively as the primary solvent, are mixed with the coal in a coal-primary solvent weight ratio of between about 0.4 and about 0.7. The primary light solvent preferably comprises between about 10% and about 50% by weight of the first solvent. The coal-primary solvent slurry is transferred, via conduit 16, to a liquefaction zone 20, where the slurry is treated under coalliquefying conditions to produce a solution containing coal liquefaction products.

In one embodiment of the present invention, the liquefaction zone 20 may comprise a reaction vessel maintained at a temperature of between about 600° F. and about 900° F. In this embodiment, it is preferred to retain the coal-primary solvent slurry in the liquefaction zone for a residence time of between about 5 minutes and about 60 minutes. It further is preferred to subject the slurry to an at least partial hydrogen atmosphere, at a partial pressure of between about 700 p.s.i.g. and about 3000 p.s.i.g., in order to increase solvolytic liquefaction reactions between the coal and the primary heavy solvent. The hydrogen atmosphere may be formed by adding molecular hydrogen to the slurry, in a hydrogen/slurry weight ratio of between about 3 and about 10, via a conduit 22 feeding into the conduit 16. If desired, the hydrogenation reaction may be promoted with a catalyst, such as a mixed nickel-molybdenum catalyst, provided in the liquefaction zone 20.

During the liquefaction step, hydrogen donor compounds in the primary heavy solvent react with the coal to form solvolytic reaction products. When the primary solvent comprises primary light solvent, at a level of between about 10% and about 50% by weight of the primary solvent, the primary light solvent functions to enhance liquefaction reactions between the coal and the first heavy solvent, by way of a mechanism which is not understood fully. However, it is believed that the primary light solvent functions to extract soluble coal products formed during liquefaction, thereby minimizing polymerization in the solid-liquid system. When the liquefaction zone 20 is maintained under conditions of supercritical temperature and/or pressure, the primary light solvent also has the tendency to reduce hydrogen bonding between acidic and basic components of soluble coal products. This hydrogen bonding reduction promotes separation of large phenols from basic organic compounds, thereby improving liquid yields.

With continued reference to FIG. 1, after the liquefaction step has been performed, a primary feed solution containing coal liquefaction products, insoluble coal products, primary heavy solvent, primary light solvent and gases preferably are transferred from the liquefaction zone 20, via a conduit 24, to a light product removal zone 26, which preferably comprises a reduced pressure flash vessel. In the light product removal zone 26, gases and those coal liquefaction products having normal boiling points below about 550° F., as well as some of the primary solvent, preferably are separated by flashing from the primary feed solution containing coal liquefaction products. The portion of the primary feed solution remaining after this separation step comprises a high-boiling primary feed solution; the treatment of this high-boiling primary feed solution will be described in greater detail hereafter.

During the separation step carried out in the light product removal zone 26, it will be understood that some components of the primary feed solution having normal boiling points above 550° F. will be removed together with the components normally boiling below 550° F. All of the components removed from the primary feed solution are transferred, via a conduit 28, from the light product removal zone 26 to a light product recovery zone 30, which preferably comprises a condenser and a gas scrubber employing a recycle stream of low-boiling liquid components. The recovered components are separated in the light product recovery zone 30 into a liquid fraction, which is withdrawn via conduit 32, and a gaseous fraction, which is withdrawn through conduit 34. The recovered liquid fraction is of particular interest as regards the present invention, since the liquid fraction comprises light product oils which are valuable as precursors of transportation and other fuels. The liquid fraction may also contain tar acids and basic materials such as quinolines and pyridines.

The gaseous fraction withdrawn from the light product recovery zone 30 next is transferred, via conduit 34, into a hydrogen regeneration zone 36, where hydrogen is separated from other gases, such as carbon monoxide and carbon dioxide, produced during the liquefaction step. Separated hydrogen is recycled via conduit 22, for use in the liquefaction step. Gases other than hydrogen are withdrawn from the hydrogen regeneration zone via conduit 38.

As shown in FIG. 1, the high-boiling primary feed solution is withdrawn from the light product removal zone 26 and is transferred, via conduit 40, to a second mixing zone 42, which preferably comprises a mixer equipped with a motor-driven agitator. The second mixing zone 42 preferably is maintained at a temperature and pressure level near that of the first separation zone 46, to be described hereafter.

In another embodiment of the method of the present invention, not shown in the Figures, additional primary light solvent, received from conduit 14, is mixed with the mixture received from the light product removal zone 26, so that primary light solvent comprises between about 60% and about 80% by weight of the high-boiling primary feed solution.

In yet another embodiment, also not shown in the Figures, conduit 14 terminates in the second mixing zone, rather than in the first mixing zone. In this embodiment, coal is mixed in the first mixing zone only with primary heavy solvent, in a coal/solvent weight ratio of between about 0.4 and about 0.7, to form a coal-primary heavy solvent slurry. The slurry is treated under coal liquefaction conditions in the liquefaction zone to form a solution containing coal liquefaction products, insoluble coal products, primary heavy solvent, and gases. This solution preferably is treated in the light product removal zone as described above to remove light products and gases. The solution then is mixed with primary light solvent in the second mixing zone to form a high-boiling primary feed solution. The primary light solvent preferably comprises between about 60% and about 80% by volume of the high-boiling primary feed solution thus produced.

With continued reference to FIG. 1, at least a portion, and preferably substantially all of the high-boiling primary feed solution is withdrawn from the second mixing zone 42 and introduced, via conduit 44, into a first primary separation zone 46, which preferably comprises a settling vessel which functions as the first stage of a multi-stage critical solvent deashing procedure. The first primary separation zone 46 preferably is maintained at a temperature between about 400° F. and about 700° F., and at a pressure between about 600 p.s.i.g. and about 1500 p.s.i.g. When the primary light solvent comprises toluene, the first primary separation zone 46 acceptably may be maintained at a temperature between about 540° F. and about 560° F., and at a pressure between about 800 p.s.i.g. and about 875 p.s.i.g. When the primary light solvent comprises toluene, the first primary separation zone 46 more preferably is maintained at a temperature of about 550° F. and at a pressure of about 850 p.s.i.g.

In the first primary separation zone 46, the elevated temperature causes the high-boiling primary feed solution to form a first heavy primary phase, comprising insoluble coal products, primary heavy solvent and primary light solvent, and a first light primary phase, comprising primary light solvent, primary heavy solvent, and coal liquefaction products such as process-generated asphaltols and high-boiling oils. The conditions in the first primary separation zone 46 cause a liquid-liquid interface to form between, and thereby to separate, the first light primary phase and the first heavy primary phase. At least a portion, and preferably substantially all of separated first heavy primary phase is withdrawn from the lower portion of the first primary separation zone 46, and is transferred via a conduit 48 to a first primary solvent recovery zone 50.

In the first primary solvent recovery zone 50, which preferably comprises a flash vessel, the pressure on the first heavy primary phase is reduced to between about 0 p.s.i.g. and about 50 p.s.i.g. This pressure reduction causes flashing of primary light solvent in the first heavy primary phase; the primary light solvent thus released is withdrawn from the first primary solvent recovery zone 50 via a conduit 52.

After the primary light solvent is flashed from the first heavy primary phase at least a portion, and preferably substantially all, of the first heavy primary phase, primarily comprising an ash concentrate, is withdrawn from the first primary solvent recovery zone 50, via a conduit 54, and is made available either for end uses or for further refining or processing, as required.

At least a portion, and preferably substantially all of the separated first light primary phase is withdrawn from the upper portion of the first primary separation zone 46 via a conduit 56. The withdrawn first light primary phase is processed in at least one primary separation zone successive to the first primary separation zone 46. In the final successive primary separation zone, a final light primary phase and a final heavy primary phase are separated. In the preferred embodiment shown in FIG. 1, the processing of the withdrawn first light primary phase is performed in two primary separation zones successive to the first primary separation zone 46, so that the final primary separation zone comprises the third primary separation zone 64. Although three primary separation zones are preferred, it should be understood that the method of the present invention may be performed with any number of primary separation zones successive to the first primary separation zone 46.

With reference to FIG. 1, the withdrawn first light primary phase preferably is treated in a heater (not shown) until the first light primary phase is heated and pressurized to near the prevailing temperature and pressure in the second primary separation zone 58. At least a portion, and preferably substantially all of the withdrawn first light primary phase then is introduced into the second primary separation zone 58, which now will be described.

The second primary separation zone 58, which preferably comprises a settling vessel, is maintained at a temperature above that in the first primary separation zone 46, and at substantially no greater pressure than that in the first primary separation zone 46. Preferably, the temperature in the second primary separation zone 58 is between about 450° F. and about 800° F., and the pressure is between about 400 p.s.i.g. and about 1500 p.s.i.g. When the primary light solvent comprises toluene, the second primary separation zone 58 suitably is maintained at a temperature of between about 640° F. and 700° F., and at a pressure of between about 750 p.s.i.g. and about 850 p.s.i.g. When the primary light solvent comprises toluene, the temperature of the second primary separation zone 58 more preferably is about 670° F. and the pressure more preferably is about 800 p.s.i.g.

In the second primary separation zone 58, the elevated temperature preferably causes the primary light phase to form a second primary heavy phase, comprising solvent refined coal and possibly some primary first light solvent, and a second light primary phase. The conditions in the second primary separation zone 58 preferably cause a liquid-liquid interface to form between, and thereby to separate, the second light primary phase and the second heavy primary phase. At least a portion, and preferably substantially all of the separated second heavy primary phase is withdrawn from the lower portion of the second primary separation zone 58, via a conduit 60.

If the withdrawn second heavy primary phase contains a significant quantity of primary light solvent, it often will be preferred to provide a second primary solvent recovery zone (not shown), which preferably comprises a flash vessel. In the second primary solvent recovery zone, the pressure on the withdrawn second heavy primary phase is reduced to between about 0 p.s.i.g. and about 50 p.s.i.g. The pressure reduction causes flashing of the primary light solvent, which may be combined with the stream flowing from the first primary solvent recovery zone 50 through conduit 52.

With continued reference to FIG. 1, at least a portion, and preferably substantially all of the separated second light primary phase is withdrawn from the upper portion of the second primary separation zone 58 into a conduit 62. At least a portion, and preferably substantially all of the withdrawn second light primary phase preferably is introduced via conduit 62 into a third, and preferably final, primary separation zone 64, to separate a third, and preferably final, light primary phase, comprising primary light solvent, and a third, and preferably final, heavy primary phase, comprising light solvent refined coal.

In one embodiment of the present invention, the third primary separation zone 64 comprises a settling vessel, which is maintained at a temperature higher than that in the second primary separation zone 58 and at substantially no greater pressure than that in the second primary separation zone 58. Preferably, the temperature in the third primary separation zone 64 in this embodiment is between about 500° F. and about 950°, and the pressure is between about 20 p.s.i.g. and about 1500 p.s.i.g. When the third primary separation zone comprises a settling vessel, the above-described conditions cause a liquid-liquid interface to form between, and thereby to separate, the third light primary phase and the third heavy primary phase. In such an embodiment, it is preferred to provide a heater (not shown) in order to elevate the temperature of the withdrawn second light primary phase flowing in the conduit 62 to near the temperature level of the third primary separation zone 64, prior to introduction of the second light primary phase into the third primary separation zone 64.

In another embodiment of the method of the present invention, the third primary separation zone 64 may comprise a flash vessel, which preferably is maintained at a pressure of between about 0 p.s.i.g. and about 50 p.s.i.g. The reduced pressure in the flash vessel causes the second light primary phase to separate into a vaporous third light primary phase and a liquid third heavy primary phase.

As shown in FIG. 1, at least a portion, and preferably substantially all of the third heavy primary phase is withdrawn from the lower portion of the third separation zone 64, via a conduit 66. If the withdrawn third heavy primary phase contains a significant quantity of primary light solvent, it often will be preferred to provide a third primary solvent recovery zone (not shown), which preferably comprises a flash vessel. In the third primary solvent recovery zone, the pressure on the withdrawn third heavy primary phase is reduced to between about 0 p.s.i.g. and about 50 p.s.i.g. The pressure reduction causes flashing of primary light solvent, which may be combined with the stream of primary light solvent flowing through conduit 52.

At least a portion, and preferably substantially all of the separated third light primary phase is withdrawn from the third primary separation zone 64, and is transferred via a conduit 68 to a light solvent surge vessel 70. The light solvent surge vessel 70 also receives primary light solvent withdrawn from the first primary solvent recovery zone 50, and from the second and third primary solvent recovery zones, via conduit 52.

At least a portion of the separated third light primary phase, together with recovered primary light solvent received through conduit 52, is withdrawn from the light solvent surge vessel 70 into conduit 14. The recycled third light primary phase, and recovered light solvent from conduit 52, both of which are received in conduit 14, provide the primary light solvent required in the first mixing zone 12 and/or the second mixing zone 42. If the amount of primary light solvent thus recycled is insufficient to meet method requirements, additional makeup primary light solvent may be introduced into the light solvent surge vessel 70 via a conduit 72.

In the preferred embodiment just described, one primary separation zone is disposed intermediate the first and final primary separation zones. However, the present invention can be practiced with any number of successive primary separation zones intermediate the first and final primary separation zones. In general, light primary phase withdrawn from the immediately preceeding primary separation zone is introduced into an intermediate primary separation zone to form a light primary phase and a heavy primary phase, preferably separated by a liquid-liquid interface. At least a portion, and preferably substantially all of the light primary phase is withdrawn from the primary separation zone and is introduced into the immediately succeeding primary separation zone, where another separation occurs. At least a portion, and preferably substantially all of the heavy primary phase formed in each intermediate primary separation zone is withdrawn from each such intermediate primary separation zone.

Figure 2:
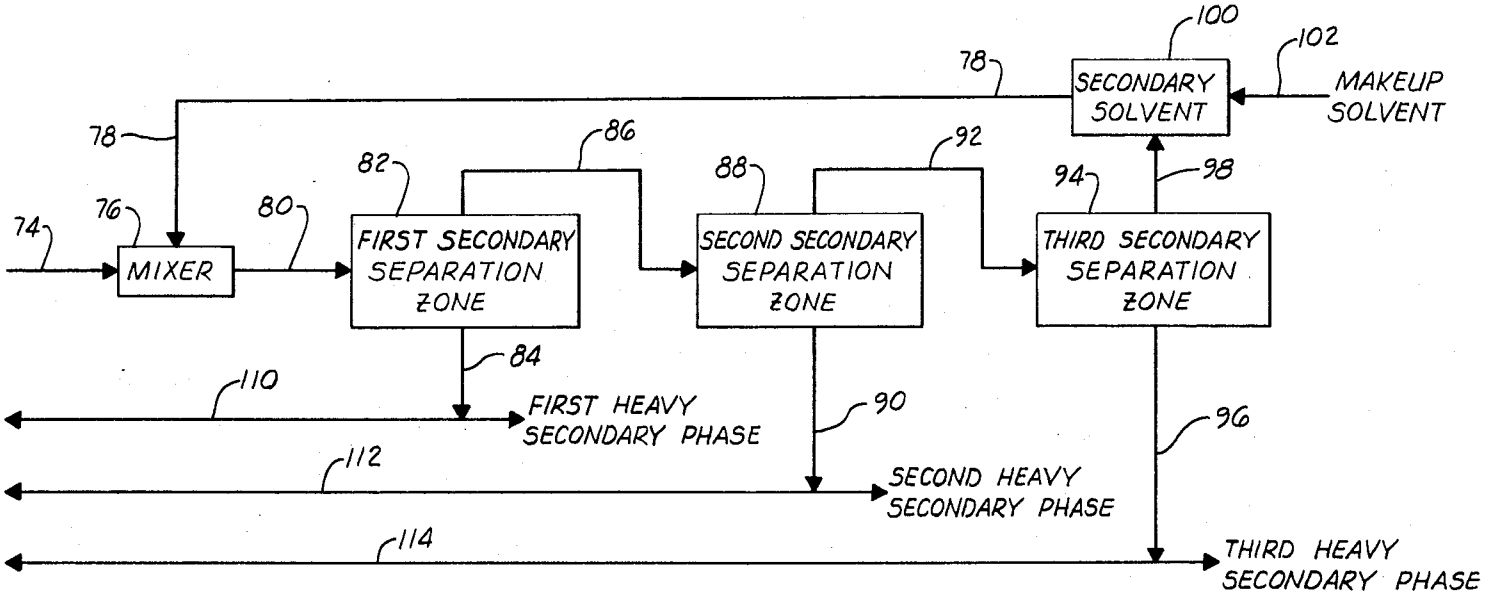
FIG. 2 is a continuation of the depiction of FIG. 1, and is a schematic, diagrammatic depiction of the flow of materials in the method of the present invention.

At least a portion of the separated third heavy primary phase is withdrwan via a conduit 74, shown in FIG. 1, and is transferred to a third mixing zone 76, shown in FIG. 2. In the third mixing zone 76, which preferably comprises a mixer with a motor-driven agitator, the separated third heavy primary phase is mixed with a secondary solvent, received via a conduit 78, to form a secondary feed solution. The third mixing zone 76 preferably is maintained at a temperature and pressure near that of the first secondary separation zone 82, to be described hereafter.

The secondary solvent comprises, and preferably consists essentially of one or more substances selected from the group comprising aromatic hydrocarbons having normal boiling points below about 350° F., paraffinic hydrocarbons having between about 3 and about 9 carbon atoms, mono-olefin hydrocarbons having between about 4 and about 8 carbon atoms, and alcohols having between about 3 and about 9 carbon atoms. More preferably, the secondary solvent comprises, and preferably consists essentially of one or more substances selected from the group comprising parafinnic hydrocarbons having between about 3 and about 9 carbon atoms. In some instances the secondary solvent and the primary light solvent may be characterized by substantially identical composition. Most preferably, the secondary solvent comprises pentane. The secondary solvent preferably comprises between about 60% and about 85% by weight of the secondary feed solution.

With continued reference to FIG. 2, at least a portion, and preferably substantially all of the secondary feed solution is transferred, via a conduit 80, to a first secondary separation zone 82, which preferably comprises a closed vessel which functions as the first stage of a multi-stage critical solvent extraction procedure. The first secondary separation zone 82 preferably is maintained at a temperature between about 150° F. and a temperature above the critical temperature of the secondary solvent. More preferably, the temperature of the first secondary separation zone 82 is maintained between about the critical temperature of the secondary solvent and about 50° F. above the critical temperature of the secondary solvent. The pressure of the first secondary separation zone 82 preferably is maintained at a pressure greater than or equal to the vapor pressure of the secondary solvent when the first secondary separation zone 82 is maintained at a temperature below the critical temperature of the secondary solvent, and at a pressure greater than or equal to the critical pressure of the secondary solvent when the first secondary separation zone 82 is maintained at a temperature greater than or equal to the critical temperature of the secondary solvent. More preferably, the pressure of the first secondary separation zone 82 is within about 300 p.s.i.g. above the critical pressure of the secondary solvent.

In the first secondary separation zone 82, the elevated temperature causes the secondary feed solution to form a first heavy phase and a first light secondary phase. The conditions in the first secondary separation zone 82 cause a liquid-liquid interface to form between, and thereby to separate, the first heavy secondary phase and the first light secondary phase. At least a portion, and preferably substantially all of the first heavy secondary phase is withdrawn from the lower portion of the first secondary separation zone 82 through a conduit 84.

If the withdrawn first heavy secondary phase contains a significant quantity of secondary solvent, it often will be preferred to provide a first secondary solvent recovery zone (not shown), which preferably comprises a flash vessel. In the first secondary solvent recovery zone, the pressure on the withdrawn first heavy secondary phase is reduced to between about 0 p.s.i.g. and about 50 p.s.i.g. The pressure reduction causes flashing of the secondary solvent, which may be transferred via a solvent conduit (not shown) to the secondary solvent surge vessel 100, to be described hereafter.

At least a portion, and preferably substantially all of the separated first light secondary phase is withdrawn from the upper portion of the first secondary separation zone 82 into a conduit 86. The withdrawn first light secondary phase is processed in at least one secondary separation zone successive to the first secondary separation zone 82. In the final successive secondary separation zone, a final light secondary phase and a final heavy secondary phase are separated. In the preferred embodiment shown in FIG. 2, the processing of the withdrawn first light secondary phase is performed in two secondary separation zones successive to the first secondary separation zone 82, so that the final secondary separation zone comprises the third secondary separation zone 94. Although three secondary separation zones are preferred, it should be understood that the method of the present invention may be performed with any number of secondary separation zones successive to the first secondary separation zone 82.

With reference to FIG. 2, at least a portion, and preferably substantially all of the withdrawn first light secondary phase is introduced via conduit 86 into a second secondary separation zone 88. Preferably, the first light secondary phase flowing in the conduit 86 is treated in a heater (not shown) in order to raise the temperature of the first light secondary phase to near that of the second secondary separation zone 88.

The second secondary separation zone 88, which preferably comprises a closed vessel, is maintained at a temperature greater than that in the first secondary separation zone 82. Preferably, the temperature in the second secondary separation zone 88 is between about 5° F. and about 100° F. higher than that in the first secondary separation zone 82. More preferably, the temperature in the second secondary separation zone 88 is between about 5° F. and 50° F. higher than that in the first secondary separation zone 82. The pressure in the second secondary separation zone 88 is greater than or equal to the vapor pressure of the secondary solvent when the second secondary separation zone 88 is maintained at a temperature below the critical temperature of the secondary solvent, and greater than or equal to the critical pressure of the secondary solvent when the second secondary separation zone 88 is maintained at a temperature greater than or equal to the critical temperature of the secondary solvent. The pressure in the second secondary separation zone 88 is substantially no greater than that in the first secondary separation zone 82, and preferably is approximately equal to that in the first secondary separation zone 82.

In the second secondary separation zone 88, the elevated temperature causes the first light secondary phase to form a second secondary heavy phase and a second secondary light phase. The conditions in the second secondary separation zone 88 cause a liquid-liquid interface to form between, and thereby to separate, the second light secondary phase and the second heavy secondary phase. At least a portion, and preferably substantially all of the separated second heavy secondary phase is withdrawn from the lower portion of the second secondary separation zone 88, via a conduit 90.

If the withdrawn second heavy secondary phase contains a significant quantity of secondary solvent, it often will be preferred to provide a second secondary solvent recovery zone (not shown), which preferably comprises a flash vessel. In the second secondary solvent recovery zone, the pressure on the withdrawn second heavy secondary phase is reduced to between about 0 p.s.i.g. and about 50 p.s.i.g. The pressure reduction causes flashing of the secondary solvent, which may be combined with the stream flowing from the first secondary solvent recovery zone through the solvent conduit (not shown).

As shown in FIG. 2, at least a portion, and preferably substantially all of the separated second light secondary phase is withdrawn from the upper portion of the second secondary separation zone 88 into a conduit 92. At least a portion, and preferably substantially all of the withdrawn second light secondary phase is introduced via conduit 92 into a third, or final, secondary separation zone 94, to separate a third, or final, secondary light phase, comprising secondary solvent, and a third, or final, heavy secondary phase.

In one embodiment of the present invention, the third secondary separation zone 94 comprises a closed vessel, which is maintained at a temperature higher than that in the second secondary separation zone 88. Preferably, the temperature in the third secondary separation zone 94 is above the critical temperature of the secondary solvent, and more preferably at least about 50° F. above the critical temperature of the secondary solvent. The pressure in the third secondary separation zone 94 is at least equal to the vapor pressure of the secondary solvent when the third secondary separation zone 94 is maintained at a temperature below the critical temperature of the secondary solvent, and at least equal to the critical pressure of the secondary solvent when the third secondary separation zone 94 is maintained at a temperature greater than or equal to the critical temperature of the secondary solvent. Preferably, the pressure in the third secondary separation zone 94 is substantially no greater than that in the second secondary separation zone 88, and more preferably the pressure is approximately equal to that of the second secondary separation zone 88. When the third secondary separation zone 94 is maintained under these conditions, a liquid-liquid interface is caused to form between, and thereby to separate, the third light secondary phase and the third heavy secondary phase. In such an embodiment, it is preferred to provide a heater (not shown) in order to elevate the temperature of the withdrawn second light secondary phase flowing in the conduit 92 to near the temperature level of the third secondary separation zone 94, prior to introduction of the second light secondary phase into the third secondary separation zone 94.

In another embodiment of the method of the present invention, the third secondary separation zone 94 may comprise a flash vessel, which preferably is maintained at a pressure of between about 0 p.s.i.g. and about 50 p.s.i.g. The reduced pressure in the flash vessel causes the second light secondary phase to separate into a vaporous third light secondary phase and a liquid third heavy secondary phase.

As shown in FIG. 2, at least a portion, and preferably substantially all of the third heavy secondary phase is withdrawn from the lower portion of the third secondary separation zone 94, via a conduit 96. If the withdrawn third heavy secondary phase contains a significant quantity of secondary solvent, it often will be preferred to provide a third secondary solvent recovery zone (not shown), which preferably comprises a flash vessel. In the third secondary solvent recovery zone, the pressure on the withdrawn third heavy secondary phase is reduced to between about 0 p.s.i.g. and about 50 p.s.i.g. The pressure reduction causes flashing of secondary solvent, which may be combined with the stream of secondary solvent flowing through the solvent conduit (not shown) from the first and second secondary solvent recovery zones.

At least a portion and preferably substantially all of the separated third light secondary phase is withdrawn from the third secondary separation zone 94, and is transferred via a conduit 98 to a secondary solvent surge vessel 100. The secondary solvent surge vessel 100 also receives secondary solvent withdrawn from the first, second and third secondary solvent recovery zones, via the solvent conduit (not shown).

At least a portion of the separated third light secondary phase, together with recovered secondary solvent received through the solvent conduit (not shown), is withdrawn from the secondary solvent surge vessel 100 via conduit 78 and is recycled to the third mixing zone 76. The recycled third light secondary phase, and recovered secondary solvent, provide the secondary solvent required to form the secondary feed solution. If the amount of recyclable secondary solvent is insufficient to meet method requirements, additional makeup secondary solvent may be introduced into the secondary solvent surge vessel 100 via a conduit 102.

In the preferred embodiment just described, one secondary separation zone is disposed intermediate the first and final secondary separation zones. However, the present invention can be practiced with any number of successive secondary separation zones intermediate the first and final secondary separation zones. In general, light secondary phase withdrawn from the immediately preceding secondary separation zone is introduced into an intermediate secondary separation zone to form a light secondary phase and a heavy secondary phase, preferably separated by a liquid-liquid interface. At least a portion, and preferably substantially all, of the light secondary phase is withdrawn from the secondary separation zone and is introduced into the immediately succeeding secondary separation zone, where another separation occurs. At least a portion, and preferably substantially all of the heavy secondary phase formed in each intermediate secondary separation zone is withdrawn from each such intermediate secondary separation zone.

With reference to FIGS. 1 and 2, the withdrawn heavy primary phases and the withdrawn heavy secondary phases, each comprising coal liquefaction products, may be transferred to end uses, or may be processed further. At least a portion of at least one of the heavy secondary phases and heavy primary phases, other than the first heavy primary phase, is recycled to provide at least a portion of the primary heavy solvent for use in the method of the present invention. More preferably, at least a portion of at least one of the heavy secondary phases, other than the first heavy secondary phase, is recycled and blended to provide at least a portion of the primary heavy solvent.

With reference to FIG. 1, a conduit 104 permits transfer of at least a portion of the second heavy primary phase to a heavy solvent surge vessel 106. A conduit 108 permits transfer of at least a portion of the third heavy primary phase to the heavy solvent surge vessel 106. As shown in both FIGS. 1 and 2, conduits 110, 112 and 114 permit transfer of at least a portion of one or more of the first heavy secondary phase, second heavy secondary phase and third heavy secondary phase, respectively, to the heavy solvent surge vessel 106.

As shown in FIG. 1, at least a portion of at least one, and preferably of a plurality, of the second heavy primary phase, third heavy primary phase, first heavy secondary phase, second heavy secondary phase and third heavy secondary phase are received in the heavy solvent surge vessel 106. These heavy primary and secondary phases are blended to form at least a portion of the primary heavy solvent. The identities and relative proportions of the heavy primary and secondary phases received in the vessel 106 preferably are selected in response to the level of distillable coal liquefaction products produced by the method. More preferably, the identities and proportions of the heavy primary and secondary phases should be selected so as to maximize the yield of distillable products produced by the method, subject to applicable economic constraints. In general it is preferred for the recycled heavy primary and secondary phases to comprise intermediate and final heavy phases recovered subsequent from separation zones successive to the first primary and first secondary separation zones.

Since the primary heavy solvent prepared in the heavy solvent surge vessel 106 is used to liquefy coal, it is preferred that the primary heavy solvent be rich in the hydrogen donor compounds which are effective coal solubilization agents. Particularly preferred phases for use in the primary heavy solvent are the second and third secondary heavy secondary phases produced in the embodiment shown in the Figures. If the primary heavy solvent has an insufficient content of such hydrogen donor compounds, it is preferred to withdraw at least a portion of the primary heavy solvent from the vessel 106 and to introduce it, via a conduit 116, into a hydrogenation zone 118.

The hydrogenation zone 118 preferably is maintained under conditions which selectively at least partially hydrogenate aromatic compounds in the first heavy solvent to hydroaromatics, which are effective coal solubilization agents. When the primary heavy solvent contains polycyclic aromatic compounds, it is preferred that at least one condensed aromatic ring in each polycyclic be retained after the hydrogenation step is completed. Because organonitrogen compounds function as effective hydrogen donors in coal solubilization, it is particularly preferred that the hydrogenation conditions minimize the number of carbon-nitrogen bonds that are broken in the treated primary heavy solvent, and that these conditions substantially preserve the integrity of organonitrogen components of the primary heavy solvent.

Molecular hydrogen is introduced into the hydrogenation zone 118 through a conduit 120. The amount of hydrogen that is introduced into the hydrogenation zone 118 should be sufficient to hydrogenate the primary heavy solvent to the extent described above, but insufficient to cause further hydrogenation of the primary heavy solvent. The hydrogen partial pressure in the hydrogenation zone 118 preferably is between about 1000 p.s.i.g. and about 3000 p.s.i.g. The temperature of the hydrogenation zone 118 preferably is maintained at between about 500° F. and about 800° F., and the primary heavy solvent preferably is retained in hydrogenation zone 118 for between about 30 minutes and about 120 minutes. The hydrogenation reaction may be promoted by introducing a hydrogenation catalyst, such as a mixed nickel-molybdenum catalyst, into the hydrogenation zone 118. After the hydrogenation step has been completed, at least partially hydrogenated primary heavy solvent from hydrogenation zone 118 is transferred, via conduit 18, to the conduit 16 where the primary heavy solvent is available to form the coal-primary solvent slurry in the method of the present invention.

Changes may be made in the construction, operation, order and arrangement of the various parts, elements, steps and procedures described herein without departing from the spirit and scope of the invention as defined in the following claims.

What is claimed is:

1. A method of liquefying and fractionating coal comprising:

mixing coal with a primary heavy solvent to form a coal-primary heavy solvent slurry;

treating the coal-primary heavy solvent slurry under coal-liquefying conditions to form a primary feed solution;

introducing at least a portion of the primary feed solution into a first primary separation zone to form a first light primary phase and a first heavy primary phase, separated by a liquid-liquid interface;

processing the separated first light primary phase in at least one primary separation zone successive to the first primary separation zone to separate, in a final successive primary separation zone, a final light primary phase and a final heavy primary phase;

mixing at least a portion of the final heavy primary phase with a secondary solvent to form a secondary feed solution;

introducing at least a portion of the secondary feed solution into a first secondary separation zone, maintained at a temperature between about 150° F. and a temperature above the critical temperature of the secondary solvent and at a pressure greater than or equal to the vapor pressure of the secondary solvent when the first secondary separation zone is maintained at a temperature below the critical temperature of the secondary solvent, and at a pressure greater than or equal to the critical pressure of the secondary solvent when the first secondary separation zone is maintained at a temperature greater than or equal to the critical temperature of the secondary solvent, to form a first light secondary phase and a first heavy secondary phase, separated by a liquid-liquid interface;

processing the separated first light secondary phase in at least one secondary separation zone successive to the first secondary separation zone to separate, in a final successive secondary separation zone, a final light secondary phase and a final heavy secondary phase; and recycling at least a portion of at least one of the separated heavy secondary phases to provide at least a portion of the primary heavy solvent which is mixed with coal.

2. The method of claim 1 in which at least a portion of at least one of the heavy secondary phases, other than the first heavy secondary phase, is recycled to provide at least a portion of the primary heavy solvent.

3. The method of claim 1 in which the identities and relative proportions of the recycled heavy secondary phases are selected in response to the level of distillable coal liquefaction products produced by the method.

4. The method of claim 1 in which the final primary separation zone comprises a third primary separation zone, and in which the processing of the separated first light primary phase comprises:

introducing at least a portion of the separated first light primary phase into a second primary separation zone to form a second light primary phase and a second heavy primary phase, separated by a liquid-liquid interface; and introducing at least a portion of the separated second light primary phase into the third primary separation zone to separate a final light primary phase and a final heavy primary phase.

5. The method of claim 4, further comprising:

recycling at least a portion of the second heavy primary phase to provide at least a portion of the primary heavy solvent.

6. The method of claim 4 in which at least a portion of at least one of the heavy secondary phases, other than the first heavy secondary phase, are recycled to provide at least a portion of the primary heavy solvent.

7. The method of claim 4 in which the identities and relative proportions of the recycled heavy secondary phases are selected in response to the level of distillable coal liquefaction products produced by the method.

8. The method of claim 4 in which the first primary separation zone is maintained at a temperature of between about 400° F. and about 700° F., and at a pressure of between about 600 p.s.i.g. and about 1500 p.s.i.g., and in which the second primary separation zone is maintained at a temperature above the temperature of the first primary separation zone and at a pressure substantially no greater than the pressure in the first primary separation zone.

9. The method of claim 4 in which the final secondary separation zone comprises a third secondary separation zone, and in which the processing of the separated first light secondary phase comprises:

introducing at least a portion of the separated first light secondary phase into a second secondary separation zone to form a second light secondary phase and a second heavy secondary phase, separated by a liquid-liquid interface; and introducing at least a portion of the separated second light secondary phase into the third secondary separation zone to separate a final light secondary phase and a final heavy secondary phase.

10. The method of claim 9 further comprising:

recycling at least a portion of at least one of the separated second heavy primary phase and the second heavy secondary phase to provide at least a portion of the primary heavy solvent.

11. The method of claim 9 in which at least a portion of at least one of the heavy secondary phases, other than the first heavy secondary phase, are recycled to provide at least a portion of the primary heavy solvent.

12. The method of claim 1 in which the final secondary separation zone comprises a third secondary separation zone, and in which the processing of the separated first light secondary phase comprises:

introducing at least a portion of the separated first light secondary phase into a second secondary separation zone to form a second light secondary phase and a second heavy secondary phase, separated by a liquid-liquid interface; and introducing at least a portion of the withdrawn second light secondary phase into the third secondary separation zone to separate a final light secondary phase and a final heavy secondary phase.

13. The method of claim 12 further comprising:

recycling at least a portion of the separated second heavy secondary phase to provide at least a portion of the primary heavy solvent.

14. The method of claim 12 in which at least a portion of at least one of the heavy secondary phases, other than the first heavy secondary phase, is recycled to provide at least a portion of the primary heavy solvent.

15. The method of claim 12 in which the second secondary separation zone is maintained at a temperature above the temperature in the first secondary separation zone and at a pressure greater than or equal to the vapor pressure of the secondary solvent when the second secondary separation zone is maintained at temperature below the critical temperature of the secondary solvent, and at a pressure greater than or equal to the critical pressure of the secondary solvent when the second secondary separation zone is maintained at a temperature greater than or equal to the critical temperature of the secondary solvent.

16. The method of claim 1 further comprising:

recyling at least a portion of the separated final light secondary phase to provide at least a portion of the secondary solvent.

17. The method of claim 1, further comprising mixing a primary light solvent with the coal-primary heavy solvent slurry.

18. The method of claim 17 further comprising:

recycling at least a portion of the separated final light primary phase to provide at least a portion of the primary light solvent.

19. The method of claim 1 in which the coal-liquefying conditions comprise a temperature of between about 600° F. and about 900° F. and a hydrogen partial pressure of between about 700 p.s.i.g. and about 3000 p.s.i.g.

20. The method of claim 1, further comprising:

mixing a primary light solvent with the primary feed solution.

21. The method of claim 17 in which the primary light solvent comprises one or more substances having a critical temperature between about 800° F. selected from the group consisting of aromatic hydrocarbons having a single benzene nucleus and normal boiling points below about 310° F., cycloparaffinic hydrocarbons having normal boiling points below about 310° F., open chain mono-olefin hydrocarbons having normal boiling points below about 310° F., open chain saturated hydrocarbons having normal boiling points below about 310° F., mono-, di- and tri-open chain amines containing between about 2 and about 8 carbon atoms, carbocyclic amines having a monocyclic structure containaing between about 6 and about 9 carbon atoms, heterocyclic amines containing between about 5 and about 9 carbon atoms, and phenols containing between about 6 and about 9 carbon atoms, and their homologs.

22. The method of claim 21 in which the primary light solvent comprises at least one of toluene, cyclohexane, and hexane.

23. The method of claim 1 in which the first primary separation zone is maintained at a temperature of between about 400° F. and about 700° F., and at a pressure of between about 600 p.s.i.g. and about 1500 p.s.i.g.

24. The method of claim 1 in which the secondary solvent comprises one or more substances selected from the group comprising aromatic hydrocarbons having normal boiling points below about 350° F., paraffinic hydrocarbons having between about 3 and about 9 carbon atoms, mono-olefin hydrocarbons having between about 4 and about 8 carbon atoms, and alcohols having between about 3 and about 9 carbon atoms.

25. The method of claim 24 in which the secondary solvent comprises pentane.

26. The method of claim 1 further comprising:

at least partially hydrogenating at least a portion of the recycled heavy secondary phases before such portion is provided as a primary heavy solvent.

27. The method of claim 1, further comprising:

recycling at least a portion of at least one of the separated heavy primary phases, other than the first heavy primary phase, to provide at least a portion of the primary heavy solvent.

28. The method of claim 27 in which the identities and relative proportions of the recycled heavy primary and heavy secondary phases are selected in response to the level of distillable coal liquefaction products produced by the method.

29. The method of claim 20 further comprising:

recycling at least a portion of the separated final light primary phase to provide at least a portion of the primary light solvent.

30. The method of claim 20 in which the primary light solvent comprises one or more substances having a critical temperature between about 800° F. selected from the group consisting of aromatic hydrocarbons having a single benzene nucleus and normal boiling points below about 310° F., cycloparaffinic hydrocarbons having normal boiling points below about 310° F., open chain mono-olefin hydrocarbons having normal boiling points below about 310° F., open chain saturated hydrocarbons having normal boiling points below about 310° F., mono-, di- and tri-open chain amines containing between about 2 and about 8 carbon atoms, carbocyclic amines having a monocyclic structure containing between about 6 and about 9 carbon atoms, heterocyclic amines containing between about 5 and about 9 carbon atoms, and phenols containing between about 6 and about 9 carbon atoms, and their homologs.

31. the method of claim 30 in which the primary light solvent comprises at least one of toluene, cyclohexane, and hexane.

* * * * *